United States Patent [19]

Peschl

[11] Patent Number: 4,602,465

[45] Date of Patent: Jul. 29, 1986

[54] SUPPORTING STRUCTURE FOR LARGE VOLUME CONTAINERS

[75] Inventor: Ir. A. S. Z. Peschl, Re Sterksel, Netherlands

[73] Assignee: Jansens & Dieperink B.V., Zaandam, Netherlands

[21] Appl. No.: 628,919

[22] Filed: Jul. 9, 1984

[30] Foreign Application Priority Data

Jul. 19, 1983 [DE] Fed. Rep. of Germany ..... 3326005

[51] Int. Cl.[4] ..... L04H 7/30

[52] U.S. Cl. ..... 52/245; 52/731; 52/192; 220/71; 138/115

[58] Field of Search ..... 52/245, 246–249, 52/192, 169.7, 730, 731, 84; 138/115, 116, 117, 172, 111; 220/71, 468, 469

[56] References Cited

U.S. PATENT DOCUMENTS

| | | | |
|---|---|---|---|
| 726,801 | 4/1903 | Maxwell | 138/115 |
| 1,115,588 | 11/1914 | Scott et al. | 52/731 |
| 1,668,179 | 5/1928 | Williams | 220/71 |
| 1,718,833 | 6/1929 | Prescott . | |
| 1,757,923 | 5/1930 | Russell . | |
| 2,273,601 | 2/1942 | Thomas | 220/71 X |
| 2,387,969 | 10/1945 | Albrecht | 52/245 |
| 2,516,020 | 7/1950 | Reed | 52/245 X |
| 3,956,860 | 5/1976 | Andrews | 52/245 |

FOREIGN PATENT DOCUMENTS

| | | | |
|---|---|---|---|
| 92761 | 5/1962 | Denmark | 52/245 |
| 434683 | 4/1948 | Italy | 52/245 |
| 108525 | 8/1917 | United Kingdom | 52/731 |
| 761775 | 11/1956 | United Kingdom | 52/245 |
| 47806 | 6/1978 | U.S.S.R. | 52/245 |

*Primary Examiner*—John E. Murtagh
*Assistant Examiner*—Richard E. Chilcot
*Attorney, Agent, or Firm*—Wallenstein, Wagner, Hattis, Strampel & Aubel, Ltd.

[57] ABSTRACT

Substantially cylindrical and relatively thin-walled large volume containers such as silos are interiorly supported by means of a supporting structure in the form of a triangular supporting triangle, which is fixedly joined to the inner container wall. Thereby an essential amount of radial loads is converted into loads working in circumferential direction, i.e., working tangentially on the container wall, so that the risk of deformations is reduced when the load transmitting members such as pipes provided inside the container are joined to the supporting structure.

7 Claims, 3 Drawing Figures

SUPPORTING STRUCTURE FOR LARGE VOLUME CONTAINERS

The invention relates to a supporting structure for substantially cylindrical and relatively thin-walled large volume containers such as silos, reservoirs, mixing containers etc.

In many fields of structural engineering, farming, power supply, stock-keeping, large-scale chemical production and the like, rationalization requires large volume containers either intended for stock-keeping or storing of materials or adapted to having processes or manufacturing processes conducted therein. Provided such large volume containers are uniformly filled with material, the loads of the material are relatively evenly distributed to the substantially cylindrical outer wall so that the latter is substantially exposed only to tangential loads, i.e., loads working in circumferential direction, such that the container wall may be relatively thin. Thin-walled containers cause less material expense and are lighter than thick-walled ones so that the costs of transport are reduced and moreover a lesser weight acts on the supporting surfaces of such large volume containers.

It has been found, however, that the container wall must be thick-walled when the loads to which it is exposed work non-uniformly. These problems will especially arise when in particular in the interior of the container loads work along load transmitting aggregates such as pipes to act on singular points or specific locations of the container wall and when such loads are no longer effective tangentially but particularly radially. This risk of deformation also occurs when external loads work non-uniformly on the container wall. While such externally working loads may frequently be eliminated by additional supporting structures mounted at the respective locations where loads are transferred to the container wall, the risk of deformation due to internally working loads poses many problems.

The invention is based on the object of providing a supporting structure for such large volume containers which prevents the risk of deformation of the large volume container while it is still of simple structure and essentially easy to assemble.

The invention resides in that in the interior of the container there is disposed in the container cross-section perpendicularly on the container axis at least one triangular supporting triangle whose ends are supported on the inside of the substantially cylindrical container wall and are especially fixedly joined to the same.

Such a "fixed joint" means a joint between the supporting triangle and the container wall such that the loads transmitted from the supporting triangle to the container wall are substantially tangential loads within the container wall; the "fixed joint" theoretically may also be understood to be a kind of "swivel location", "hinge line" or "pivot".

Therefore the supporting triangle essentially has the function of converting the loads which occur non-uniformly within the container and which act particularly in radial direction to deform the container and especially to cause dents therein, into such loads that are effective in the container wall substantially only tangentially, i.e., in circumferential direction. Such a supporting triangle can be easily made, for instance by joining three supporting braces which form an equal-sided triangle and the ends of which are contiguously joined to each other. The circumscription of the intersection of these triangle ends approximately corresponds to the circle formed through the centre plane of the container wall of circular cross-section, so that when the supporting triangle is inserted into the container or, respectively, the container is fitted onto the supporting triangle, the container is practically not deformed. The tips of the triangle, which are offset relative to each other in the container at an angle of about 120°, prevent denting of the container at the respective locations, i.e., these triangles provide inward support at such locations. If these triangle tips are not merely loosely engaged with the inner surface of the container wall but are fixedly joined to the container wall, a still better load transmission in tangential direction of the container wall will be achieved.

Then, the supporting structure constitues the arrangement on which the loads that occur non-unifomly in the container interior may work; for instance pipes, provided they transmit loads, are fixedly joined to the supporting triangle, particularly by welding.

In many cases, for instance in the case of a plurality of loads acting in different directions, it is advisable to combine two or even more of said supporting triangles with one another. In accordance with this special embodiment of the invention at least two supporting triangles are joined to each other such that their ends are supported on the inside of the container wall and are fixedly joined thereto, and that in the vicinity of load working locations the supporting triangles are also fixedly interconnected.

By appropriate selection of the angles between the portions of the supporting triangles extending from such joints towards the container wall it is possible to provide for an optimum balancing of loads; it is even possible to equalize a large amount of the loads acting in different directions within the combination of supporting triangles such that these loads do not even exhibit their full effect on the container wall.

It is furthermore possible within the scope of the present invention to utilize the supporting triangle for absorbing such loads that would be transmitted to the container wall from outside of the container if the supporting triangle of the instant invention were not provided. To this end the loads transmitted from outside to the container wall are transmitted directly from the transmitting location in the same direction through the container wall to the supporting triangle; this may be achieved, for instance, by a load transmitting member fixedly mounted between the respective working location on the container wall and the supporting triangle.

The invention will be described below by means of two especially preferred embodiments thereof with reference to the accompanying drawing, in which FIG. 1 is a schematic external view of a container and a supporting structure provided therein, wherein the container lid has been removed;

Figure 1:
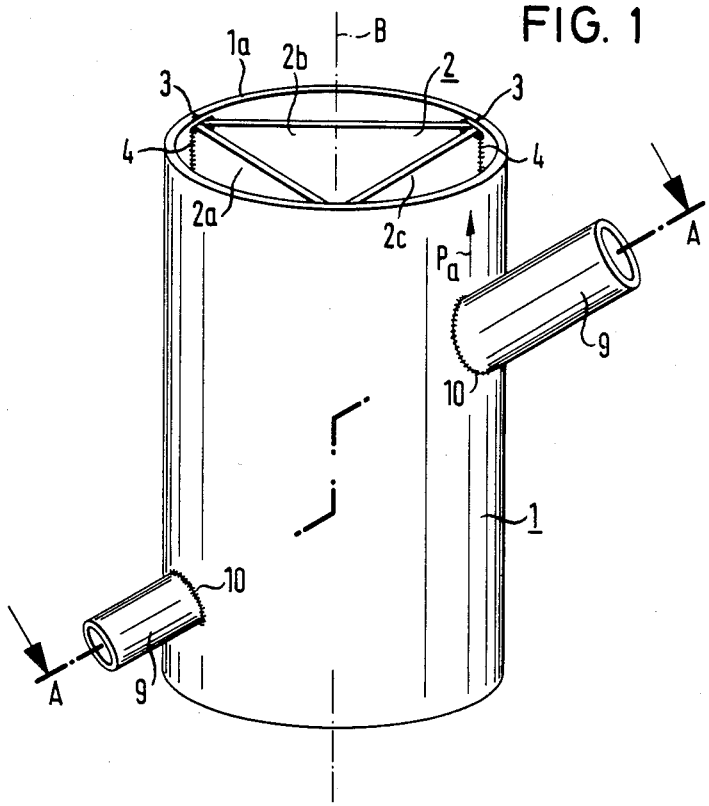

As shown in FIG. 1, the container 1 has a supporting triangle 2 provided therein the ends 3 of which, which are uniformly circumferentially supported on the inside of the container wall 1, additionally are welded by means of weld joints 4 to the inside of the container wall 1*a*. The container wall 1*a* is cylindrical, and the axis of the cylinder corresponds to the container axis B. Although the figure does not show any load transmitting members such as pipes, it is clear that external pipes 9 extend from outside to the container 1 and are welded to the container wall 1*a* through weld joints.

Figure 2:
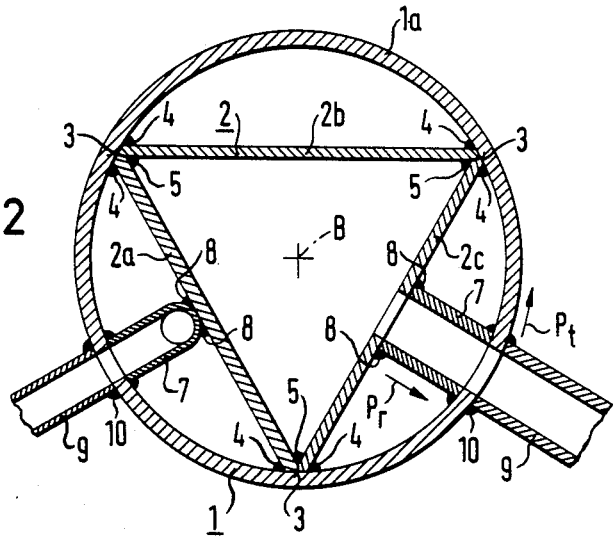
FIG. 2 is a cross-sectional view along the lines A—A in FIG. 1.

FIG. 2 shows that the external pipes 9, which apply radial loads $P_r$ to the container wall 1*a*, are fixedly joined by means of weld joints 8 to the supporting triangle 2 for load transmission by means of extensions, as it were, i.e., in the same axial direction as the axes of the external pipes 9. While the external pipe 9 shown at the bottom right-hand side of FIG. 2 continues via the adjoining pipe 7 as an extension thereof, so that communication between the external pipe 9 through the container wall 1*a* and through the pipe 7 and even through the supporting brace 2*c* with the interior of the supporting triangle 2 is permitted, the pipe 7 shown on the left-hand side of FIG. 2, which is the extension of the external pipe 9, is bent downwards at the location where it reaches the supporting brace 2*a* of the supporting triangle 2. However, the weld joints 8 provide for a good load transmission and thus equalization of the radial forces $P_r$, which due to the weld joints 4 at the ends 3 of the supporting triangle 2 are transmitted as tangential loads $P_t$ to the container wall 1*a*, although part of the load may even be absorbed by the third supporting brace 2*b* of the supporting triangle 2.

Thus, in contrast to conventional devices of this type the weld joints 10 need no longer accommodate all the loads working in radial direction of the container 1.

FIG. 1 also schematically shows an axial load $P_a$. Since such axial loads $P_a$ practically do not contribute to a deformation of the container wall 1*a*, no special supporting measures will normally have to be provided in this respect.

Figure 3:
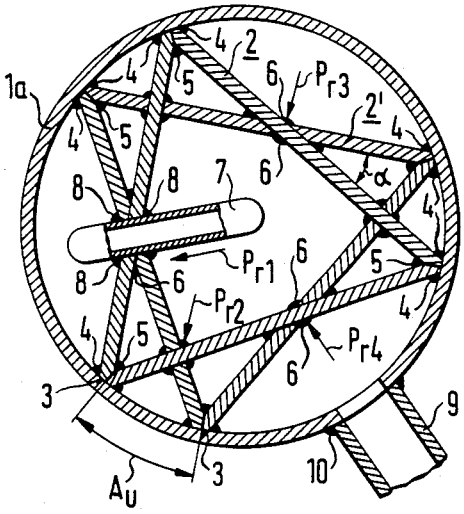
FIG. 3 is a corresponding cross-sectional view through another embodiment of the invention, in which two supporting triangles are used.

As shown in FIG. 3, a combination of two fixedly joined supporting triangles 2, 4' is inserted into the container 1. These two supporting triangles 2, 2' are relatively offset at an angle $\alpha$ such that their ends 3, where the supporting braces are joined to each other by weld joints 5, are spaced from each other with a spacing $A_U$ about the periphery of the container wall 1.

Here, too, weld joints 4 are provided between these ends 3 of the supporting triangles 2, 2' and the inside of the container wall 1*a*. For instance, inside the container the schematically shown pipe 7 transmits a first radial load $P_{r1}$ in the direction of the arrow to the two supporting triangles 2, 2', which at the respective working location of the pipe 7 are not only joined to the pipe 7 through weld joints 8 but are also fixedly joined to each other through weld joints 6.

In a corresponding manner, weld joints 6 are provided at the other load working locations $P_{r2}$, $P_{r3}$ between the supporting triangles 2, 2'.

In these embodiments of the invention, substantially no radial loads act through the external pipe 9 on the container wall 1*a*, so that the external pipe 9 may terminate on the outer wall 1*a* and the weld joint 10 between the external pipe 9 and the container wall 1*a* practically does not transmit any radial loads.

Advantageously, in addition to the relatively thin-walled container wall also the supporting triangles should be made of aluminum or an aluminum alloy.

Although weld joints are respectively shown and described in the above embodiments it is also possible to use other load transmitting joints such as rivet joints or screw joints; however, due to their rigidity weld joints have proven most advantageous in the majority of cases.

The supporting triangle should be disposed within the container such that it transmits loads substantially tangentially to the container wall; in this respect the supporting triangle constitutes a load transmitting member effective to change the direction of the loads such that deformations of the wall are reduced.

Instead of the weld joints it is also possible to use other connecting elements such as threaded bolts.

What is claimed is:

1. A large volume container such as a silo, reservoir, mixing container, and the like, comprising: a hollow, substantially cylindrical, relatively thin-walled material receiving container; and at least one triangularly shaped supporting means mounted within said container, said supporting means comprising plate-like members arranged within said container in the form of a triangle the axis through the center thereof being substantially parallel to the longitudinal axis of said container, the apexes of said triangularly shaped supporting means being secured along the wall of said container; and load transmitting means fixedly secured to said supporting means for transmitting any radially directed loads tending to deform the wall of said container tangentially with relation to said wall thereby to prevent deformation of the container wall.

2. A container as claimed in claim 1 wherein each of the apexes of the triangularly shaped supporting means are secured along the wall of the container by at least one weld joint.

3. A container as claimed in claim 1 wherein the plate-like members are of substantially the same width and length and composed to form an approximately equal-sided triangle such that the abutting ends of said members form the apexes of the supporting means.

4. A container as claimed in claim 1, wherein at least two triangularly shaped supporting means are mounted within said container with the apexes of each of the supporting means being offset with respect to the apexes of the other supporting means and with the apexes of each of the supporting means being secured along the wall of said container, said at least two supporting means being fixedly joined to each other at load bearing points within the container whereby tangential transmission of the load with relation to the container wall occurs.

5. A container as claimed in claim 1 wherein the load transmitting means comprises at least one pipe fixedly secured to the supporting means for transmitting loads from outside the container to the interior of the container.

6. A container as claimed in claim 1, wherein the load transmitting means is fixedly joined to the supporting means by weld joints.

7. A container as claimed in claim 4 wherein load transmitting means in the form of a pipe is fixedly secured to one of said at least two triangularly shaped supporting means.

* * * * *